United States Patent [19]

Kamarian

[11] 4,059,500

[45] Nov. 22, 1977

[54] ELECTRODE UNIT

[76] Inventor: Georgy Mikirtychevich Kamarian, Kotelnicheskaya naberezhnaya, 25/8, kv. 45, Moscow, U.S.S.R.

[21] Appl. No.: 676,206

[22] Filed: Apr. 12, 1976

[30] Foreign Application Priority Data

Apr. 14, 1975 U.S.S.R. ..... 2122952

[51] Int. Cl.[2] ..... C25B 1/26; C25B 9/02

[52] U.S. Cl. ..... 204/288; 204/254; 204/256; 204/258; 204/289

[58] Field of Search ..... 204/254, 255, 256, 268, 204/280, 286, 288, 258, 289

[56] References Cited

U.S. PATENT DOCUMENTS

| | | | |
|---|---|---|---|
| 1,092,369 | 4/1914 | Kolsky | 204/288 X |
| 2,682,505 | 6/1954 | Greco | 204/284 |
| 3,507,771 | 4/1970 | Dönges et al. | 204/284 |
| 3,900,384 | 8/1975 | Gunby | 204/286 |
| 3,930,980 | 1/1976 | De Nora et al. | 204/256 |
| 3,969,216 | 7/1976 | Barrett | 204/286 |

*Primary Examiner*—Arthur C. Prescott
*Attorney, Agent, or Firm*—Lackenbach, Lilling & Siegel

[57] ABSTRACT

The proposed electrode unit of an electrolyzer for electrolysis of solutions of halogenides of alkali metals comprises a current-distribution support to which there is electrically coupled at least one open-work or perforated electrode member at whose working surfaces there is released gas in the course of the electrolysis of solutions of halogenides of alkali metals. The open-work or perforated electrode member is so arranged in relation to the current-distribution support that its working surfaces are at a certain angle to the vertical plane extending perpendicularly to the plane of the current-distribution support on the side of the electrode member.

20 Claims, 21 Drawing Figures

ELECTRODE UNIT

The present invention relates to electrolyzers for the electrolysis of solutions of halogenides of alkali metals to produce, for example, chlorine, caustic soda and hydrogen and, more particularly, to electrode units of such electrolyzers. Still more specifically, the invention relates to anode and cathode assemblies and bipolar electrodes.

There is known an electrode unit of an electrolyzer for the electrolysis of solutions of halogenides of alkali metals, comprising a vertically arranged main current-distribution support, to which there is electrically connected at least one open-work or perforated electrode member, at whose working surfaces there is released gas during the electrolysis of solutions of halogenides of alkali metals.

When the electrode unit is used as the cathode assembly of an electrolyzer, it includes a number of vertically arranged parallel open-work or perforated electrode members constructed as hollow fingers attached to the cathode grid which, in turn, is secured to the main current-distribution support. When intended for the production of chlorine and caustic soda, the cathode grid and electrode members of the cathode assembly are provided with a diaphragm cover.

When the electrode unit is used as the anode assembly of an electrolyzer, it also includes a number of vertically arranged parallel open-work or perforated electrode members constructed as hollow fingers attached to the main current-conducting support.

The hollow fingers of the anode assembly make up a rigid structure; as a result, the open-work or perforated electrode members are rigidly secured in place.

When the electrode unit is used as a bipolar electrode of an electrolyzer, which comprises an anode assembly and a cathode assembly, these assemblies have a common main current-distribution support to which on one side there are attached vertical and parallel open-work or perforated electrode members of the anode assembly constructed as hollow fingers, whereas on the other side, to said main current-distribution support there are attached vertical and parallel open-work or perforated electrode members of the cathode assembly, which are also constructed as hollow fingers.

There must be at least one open-work or perforated electrode member in an electrode unit; the number of such members differs, depending on the required output.

When installing an anode assembly, a cathode assembly and a bipolar electrode in an electrolyzer, the hollow fingers of the anode assembly are arranged between the hollow fingers of the adjacent cathode assembly. The working surfaces of the electrode elements of both assemblies are vertical.

The vertical arrangement of the working surfaces of the electrode members imposes certain limitations on the height of said electrode members (which height is normally 1.0 to 1.5 m) due to certain electrochemical processes involved in the electrolysis. These limitations in turn, account for limited output per unit of floor space.

The enlargement of the working surfaces of the electrode members by raising their height results in an increasing amount of gas in the upper portion of the interelectrode space, i.e. of the spacing between the working surfaces, because the gas, which is released in the course of the electrolysis of solutions of halogenides of alkali metals, moves upwards. The increasing amount of gas in the upper portion of the interelectrode space increases, in turn, the resistance of the electrolyte and, consequently, the cell voltage. The difference in the gas content over the electrode height leads to non-uniform current distribution over the electrode members. All these factors result in an increased power consumption in the course of the electrolysis.

The rigid fixing of open-work or perforated members of the anode assembly makes it difficult to assemble an electrolyzer. The number of electrode members in industrial electrolyzers is quite considerable, so it is extremely difficult to install all the electrode members of the anode assembly between the electrode members of the cathode assembly and ensure a uniform interelectrode spacing.

It is an object of the present invention to provide an electrode unit which would reduce the amount of gas released in the interelectrode space of the anode and cathode assemblies.

It is another object of the invention to provide an electrode unit which would make it possible to raise the output per unit of floor space.

It is still another object of the invention to provide an electrode unit which would reduce power consumption.

It is yet another object of the invention to provide an electrode unit which would make it easier to assemble an electrolyzer.

The foregoing objects of the present invention are attained by providing an electrode unit comprising a vertically arranged main current-distribution support, to which there is electrically coupled at least one open-work or perforated electrode at whose working surfaces there is released gas in the course of the electrolysis of solutions of halogenides of alkali metals, in which electrode unit the open-work or perforated electrode member is so arranged, in accordance with the invention, relative to the main current-distribution support that its working surfaces are at a certain angle to the vertical plane extending perpendicularly to the plane of the main current-distribution support on the side of the electrode member.

When the electrode unit is to be used as the anode assembly of an electrolyzer, it is expedient that it be provided with an additional current-distribution support attached to the main current-distribution support and electrically connected thereto, whereas the open-work or perforated electrode member be mechanically and electrically coupled to said additional current-distribution support.

The open-work or perforated electrode member of the anode assembly may include a pair of plates joined so as to form a V-shaped member; said electrode member may be secured to the additional current-distribution support at the junction of said plates so that the plates are found on the opposite sides of the additional current-distribution support.

It is desirable that the open-work or perforated electrode member include at least one more pair of plates attached to the additional current-distribution support on its both sides and on the side of the upper butt ends of the plates of the V-shaped member, so that the working surfaces of said additional plates are on the same plane with the working surfaces of the plates of the V-shaped member.

It is preferable that the open-work or perforated electrode member of the anode assembly include two separate plates arranged on both sides of the additional current-distribution support, while said support be shaped as an inverted T, said separate plates being secured to the sides of the base of the inverted T.

The butt ends of said separate plates may be in immediate proximity to the cross-bars of said additional current-distribution support and may be joined by a connector into one plate.

When the electrode unit is to be used as the cathode assembly, it is expedient that it be provided with an open-work or perforated electrode member shaped as a triangular prism whose side edges are perpendicular to the main current-distribution support.

It is preferable that the faces of the prism, which are the working surfaces of the open-work or perforated electrode member of the cathode assembly, be congruent with the working surfaces of the open-work or perforated electrode member of the anode assembly constructed as described above.

When the electrode unit is employed as a bipolar electrode of an electrolyzer, having anode and cathode assemblies, it is expedient that the open-work or perforated electrode member of both the anode and cathode assemblies be constructed as described above.

The electrode unit constructed in accordance with the invention makes the filling of the interelectrode space with gas independent of the height of the electrode members and minimizes the amount of gas in the interelectrode space, which makes it possible to substantially reduce the interelectrode spacing, cut down power consumption and raise the height of the electrode members. In addition, the electrode members of the anode assembly built according to the invention are flexible, which speeds up and facilitates the assembly and dismantling of electrolyzers.

The foregoing and other objects and advantages of the present invention will become more apparent from the following detailed description of preferred embodiments thereof taken in conjunction with the accompanying drawings, wherein.

Referring now to the attached drawings, the proposed electrode unit of an electrolyzer for the electrolysis of solutions of halogenides of alkali metals comprises a vertically arranged main current-distribution support 1 (FIGS. 1 and 2) constructed as a rectangular bimetal plate (a steel-titanium plate). (Although the support 1 has different dimensions in different embodiments of the invention, it is designated as 1 throughout the text of the disclosure for greater clarity). The plate may also be copper-titanium and steel-copper-titanium. The plate may be made of steel and covered on the anode side with a protective coating.

Electrically connected to the support 1 is an open-work or perforated electrode member 2 at whose working surfaces 3 there is released gas in the course of the electrolysis of solutions of halogenides of alkali metals. The open-work or perforated electrode member 2 is so arranged in relation to the main current-distribution support 1 that its working surfaces 3 are at a certain angle to the vertical plane extending at a perpendicular to the plane of the main current-distribution support 1 on the side of the electrode member 2. This angle may vary from 1° to 85°, but the optimum angle is between 1° and 10°.

Figure 1:
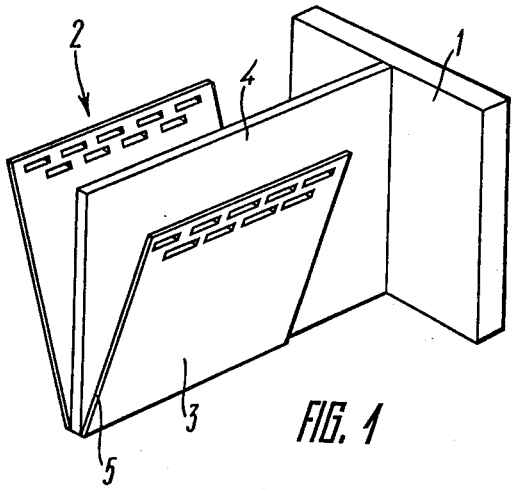
FIG. 1 is a general perspective view of an electrode unit in accordance with the invention, used as an anode assembly.

When the electrode unit of the present invention is used in an electrolyzer as the anode assembly of FIG. 1, it is provided with an additional current-distribution support 4 secured at a perpendicular to the main current-distribution support 1 which is the above-mentioned vertical plane. The additional support 4 is electrically connected to the main support 1. The support 4 is a rectangular titanium plate (it may also be a plate of copper or steel, covered with a protective layer, for example, a thin titanium sheet).

Figure 4:
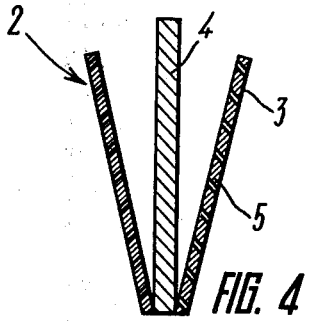
FIG. 4 is a cross-sectional view of the perforated electrode member of the anode assembly of FIG. 1.

In the embodiment under review, the electrode member 2 is perforated and coupled both mechanically and electrically to the additional support 4. The perforated electrode member 2 includes a pair of plates 5 of titanium covered with an active material, for example, ruthenium dioxide. The plates 5 are joined together to form a V-shaped member attached to the additional current-distribution support 4 at the junction of said plates 5, so that the plates 5 are found on the opposite sides of said additional support 4, as shown in FIG. 4. This way of joining the electrode member 2 to the support 4 accounts for the flexibility of the plates 5, which makes it easier to assemble an electrolyzer. (Although the support 4 and plates 5 have different dimensions in different embodiments of the invention, they are designated throughout the text of the disclosure as 4 and 5, respectively, for greater clarity).

Figure 5:
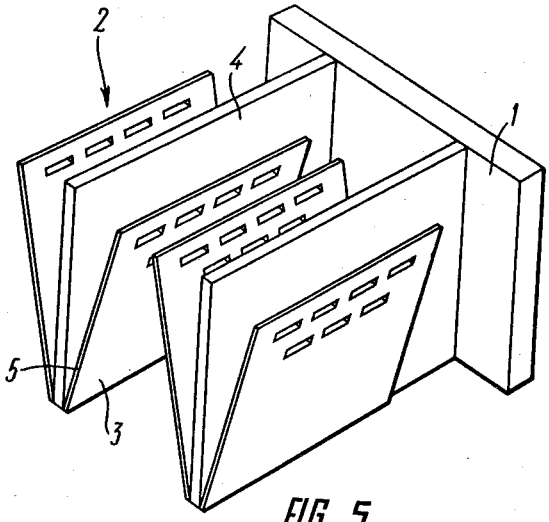
FIG. 5 is a general perspective view of an electrode unit in accordance with the invention, constructed as an anode assembly with two electrode members.

FIG. 5 shows an anode assembly with two perforated electrode members 2 which are similar to the perforated electrode member 2 of FIG. 1 and are attached to the main current-distribution support 1. The number of the electrode members is determined by the required capacity of the electrolyzer.

In an electrolyzer of a great height, one can successfully use in the anode assembly a perforated electrode member 2 (FIG. 6) which comprises a pair of plates 5 of the electrode member 2 of FIG. 1 and also includes a pair of plates 6 secured to the additional current-distribution support 4 on both sides thereof and on the side of the upper butt ends of the plates 5 of the V-shaped member, so that the working surfaces 3 of the plates 6 are in the same plane with the working surfaces 3 of the plates 5 of the V-shaped member. The plates 6 are attached to the support 4 by means of perforated plates 7.

Figure 6:
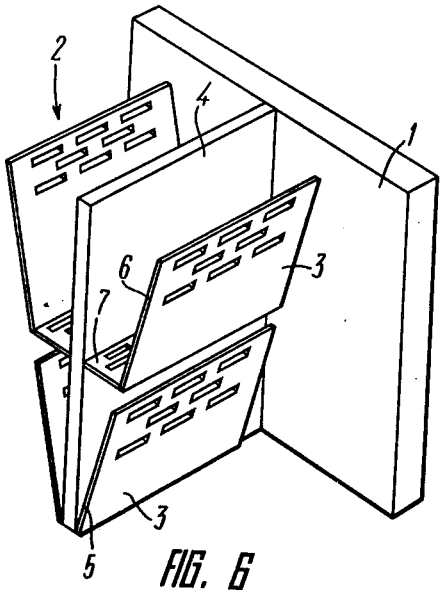
FIG. 6 is a general perspective view of an alternative embodiment of the electrode unit in accordance with the invention, used as an anode assembly.
Figure 7:
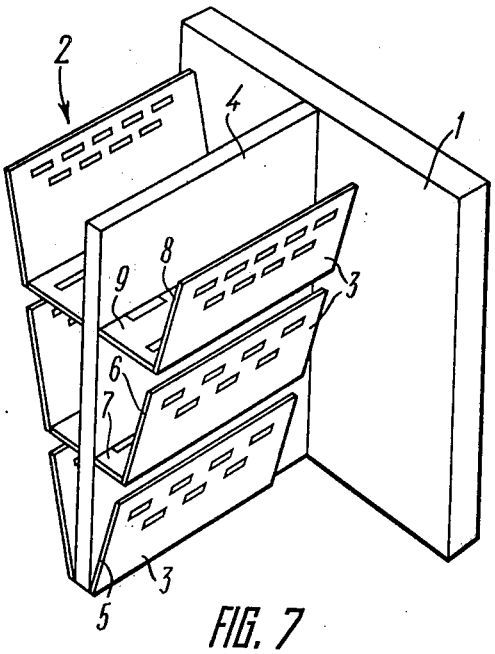
FIG. 7 is a general perspective view of another alternative embodiment of the electrode unit in accordance with the invention, used as an anode assembly.

FIG. 7 shows an alternative embodiment of the anode assembly, which is similar to that of FIG. 6. The difference between the two embodiments resides in the fact that the perforated electrode member 2 of FIG. 7 includes one more pair of plates 8 which are secured to the support 4 by means of perforated plates 9. The number of plates of an electrode member is determined by the height of the electrolyzer.

Figure 8:
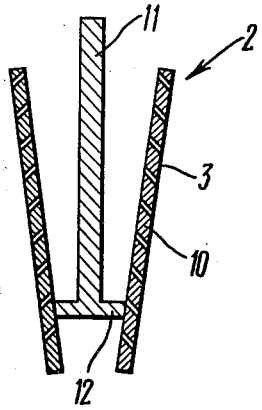
FIG. 8 is a cross-sectional view of an electrode member of an anode assembly in accordance with the invention.

FIG. 8 shows an open-work electrode member 2 of an anode assembly. The electrode member 2 comprises two separate plates 10 with working surfaces 3 arranged on both sides of an additional current-distribution support 11 which is shaped as an inverted T. The plates 10 are attached to cross-bars 12 of the inverted T, in immediate proximity to their ends.

Figure 9:
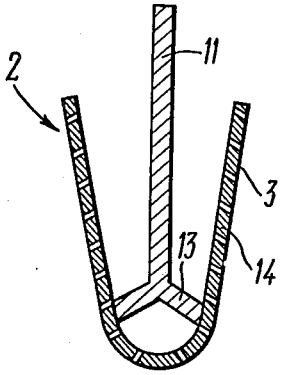
FIG. 9 is a cross-sectional view of an alternative embodiment of the electrode member of FIG. 8.

The modified electrode member 2 of FIG. 9 is also highly effective. According to this embodiment, cross-bars 13 (FIG. 9) of the support 11 are at a certain angle to said support 11. The butt ends of the plates are in immediate proximity to the cross-bars 13 and are joined by a connector into one plate 14.

Figure 10:
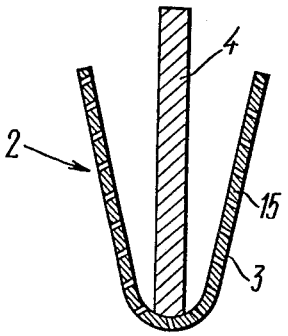
FIG. 10 is a cross-sectional view of another alternative embodiment of the electrode member in accordance with the invention.

According to FIG. 10, the butt ends of the plates with the working surfaces 3 of the electrode member 2 are also joined by a connecting strip into one plate 15; in this case the additional support 4 may be constructed as that of FIG. 1.

Figure 2:
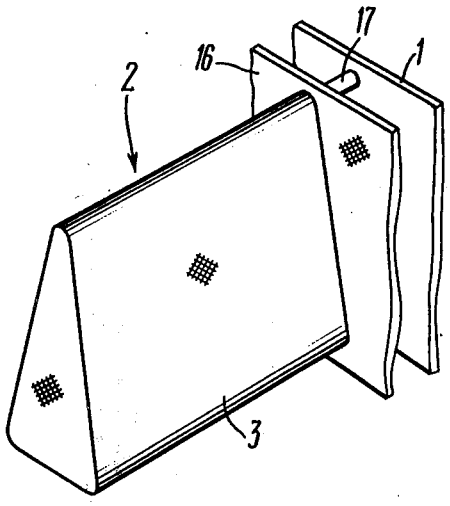
FIG. 2 is a general perspective view of an electrode unit in accordance with the invention, used as a cathode assembly.

If the electrode unit of the present invention is used as the cathode assembly of an electrolyzer, as shown in FIG. 2, said electrode unit is provided with a cathode grid 16 to which there is attached an open-work electrode member 2. The open-work electrode member 2 is constructed in the form of a triangular prism whose side edges are perpendicular to the main current-distribution support 1. The side edges of the prism are rods 17 which act as stiffening elements by means of which the cathode grid 16 is attached to the main current-distribution support 1 at a certain spacing therefrom, which spacing is used to collect hydrogen and alkali released in the course of the electrolysis of solutions of halogenides of alkali metals. The electrode member 2 is made of steel and provided with a diaphragm cover (not shown) in order to avoid mixing of the anodic and cathodic products.

Figure 11:
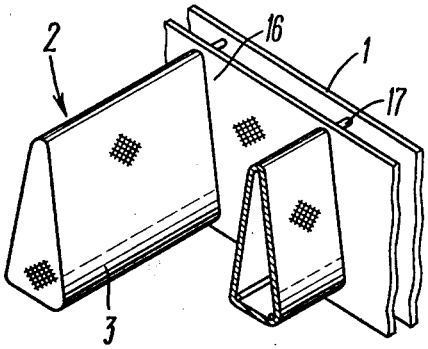
FIG. 11 is a general perspective view of an electrode unit in accordance with the invention, constructed as a cathode assembly with two electrode members.

The cathode assembly of an electrolyzer may comprise two open-work electrode members 2 (FIG. 11) attached to the cathode grid 16. (In this case, the size of the grid 16 is different from that of the grid 16 of FIG. 2; that notwithstanding, the grid is designated here and elsewhere in the text of the disclosure as 16, which is done for greater clarity).

The number of electrode members in the cathode assembly is determined by the required capacity of the electrolyzer.

Figure 3:
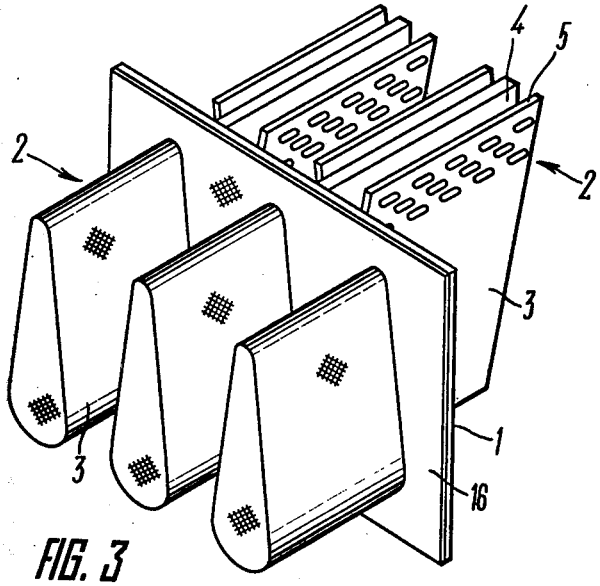
FIG. 3 is a general perspective view of an electrode unit in accordance with the invention, used as a bipolar electrode.

If the electrode unit of the present invention is used as a bipolar electrode of an electrolyzer, which is shown in FIG. 3 and has anode and cathode assemblies, the perforated electrode member 2 of the anode assembly is constructed as that of FIG. 1, whereas the open-work electrode member 2 of the cathode assembly is constructed as that of FIG. 2. In this case, however, the main current-distribution support is common for both electrode members.

Apart from the embodiment of FIG. 3, there may be other embodiments of a bipolar electrode with electrode members of the anode assembly. Some of these are shown in FIGS. 6, 7, 8, 9 and 10.

Thus far, the disclosure has dealt with some preferred embodiments of electrode members of anode and cathode assemblies, as well as of anode and cathode assemblies of a bipolar electrode.

Figure 12:
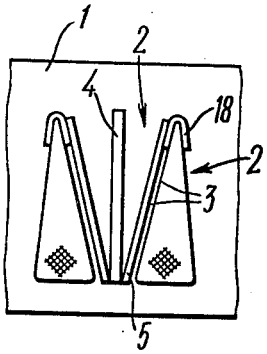
FIG. 12 is a front elevational view of the electrode members of the anode and cathode assemblies of FIGS. 1 and 2, respectively, installed in an electrolyzer (a frontal view of the electrode members and the main current-distribution support)

The optimum embodiment of the electrode members 2 is shown in FIG. 12. In this case, the faces of the prism, which are the working surfaces 3 of the open-work electrode member 2 of the cathode assembly of FIG. 2, are congruent with the working surfaces 3 of the perforated electrode member 2 of the anode assembly.

In order to accurately maintain the spacing between the working surfaces 3 of the electrode members 2 of the anode and cathode assemblies, it is expedient that on the upper end face of the electrode member 2 of the cathode assembly there should be mounted a V-shaped fixing element 18 made of a non-conducting, chlorine-resistant material, for example, fiber-glass plastic. If the electrode members 2 of the anode assembly are not accurately installed between the electrode members 2 of the cathode assembly, the fixing element 18 appropriately deforms the electrode members 2 of the anode assembly of FIG. 1, which are rigidly secured to the support 4. As a result, the electrode members 2 of the anode assembly are brought to the desired position.

The congruence of the working surfaces of the electrode members of the anode and cathode assemblies is typical of the anode and cathode assemblies as such and of the anode and cathode assemblies of a bipolar electrode, so the above-mentioned FIG. 12 and FIGS. 13, 14, 15 and 16 that are dealt with below are all related both to individual anode and cathode assemblies of an electrolyzer and to those of a bipolar electrode. This minimizes power consumption.

Figure 13:
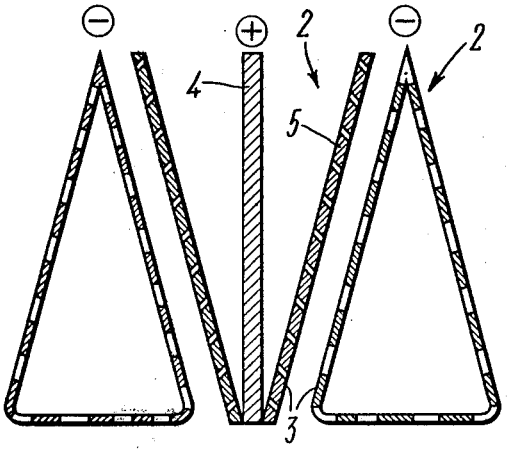
FIG. 13 is a cross-sectional view of the electrode members of the anode and cathode assemblies of FIGS. 1 and 2, respectively, installed in an electrolyzer.

FIG. 13 shows congruent working surfaces 3 of the electrode members 2 of the anode assembly of FIG. 1 and cathode assembly generally similar to the cathode assembly shown in FIG. 2, but without the fixing element.

Figure 14:
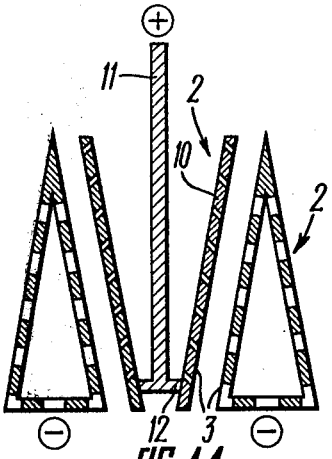
FIG. 14 is a cross-sectional view of the electrode members of the anode and cathode assemblies of FIGS. 8 and 2, respectively, installed in an electrolyzer.

FIG. 14 shows congruent working surfaces 3 of the electrode members 2 of the anode assembly of FIG. 8 and cathode assembly generally similar to the cathode assembly shown in FIG. 2.

Figure 15:
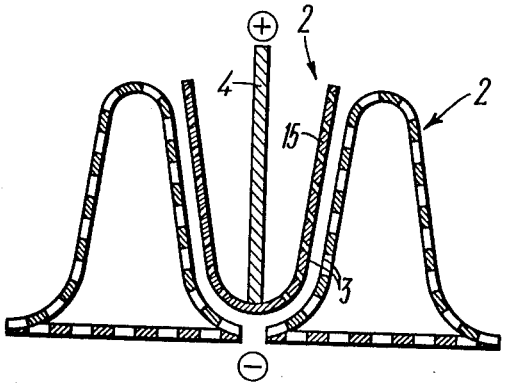
FIG. 15 is a cross-sectional view of the electrode members of the anode and cathode assemblies of FIGS. 10 and 2, respectively, installed in an electrolyzer.

FIG. 15 shows congruent working surfaces 3 of the electrode members 2 of the anode assembly of FIG. 10 and cathode assembly generally similar to the cathode assembly shown in FIG. 2.

The working surfaces 3 (FIG. 16) of a single plate 19 of the electrode member 2 of the anode assembly, which in this case is open-work, are more convex than the working surfaces 3 (FIG. 15) of the plate 15 of the electrode member 2 of the anode assembly; consequently, the working surfaces 3 of the electrode member 2 (the faces of the prism), which in this case is perforated, are more concave, i.e. they are congruent with the working surfaces 3 of the electrode member 2 of the anode assembly.

Figure 16:
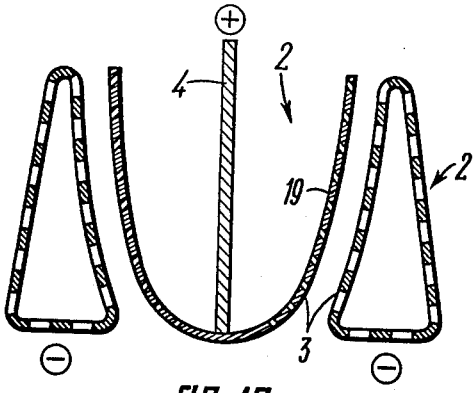
FIG. 16 is a cross-sectional view of an alternative embodiment of the electrode members of FIG. 15.
Figure 17:
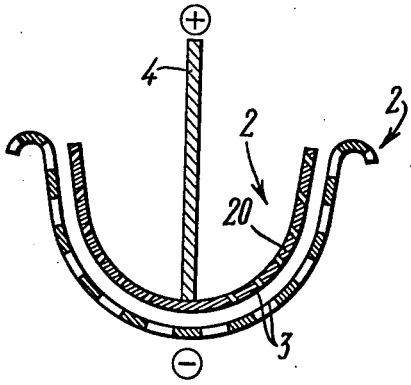
FIG. 17 is a cross-sectional view of an alternative embodiment of the electrode members of FIG. 16.

According to the embodiment shown in FIG. 17, the working surfaces 3 of a single plate 20 of the anode assembly are still more convex, as compared to the embodiment of FIG. 16; accordingly, the working surfaces 3 of the electrode member 2 of the cathode assembly are still more concave and joined together, which makes them congruent with those of the anode assembly.

Figure 18:
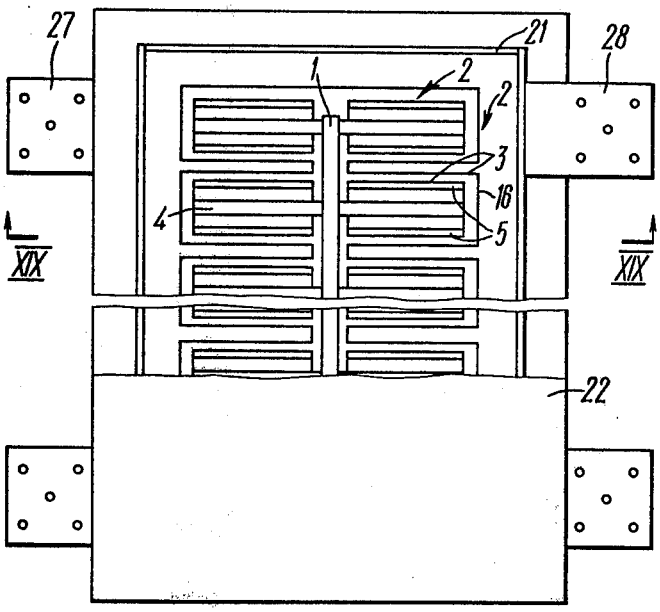
FIG. 18 is a plan view, with part of the cover broken away to show interior details, of an electrolyzer with separate anode and cathode assemblies, in accordance with the invention, installed therein.
Figure 19:
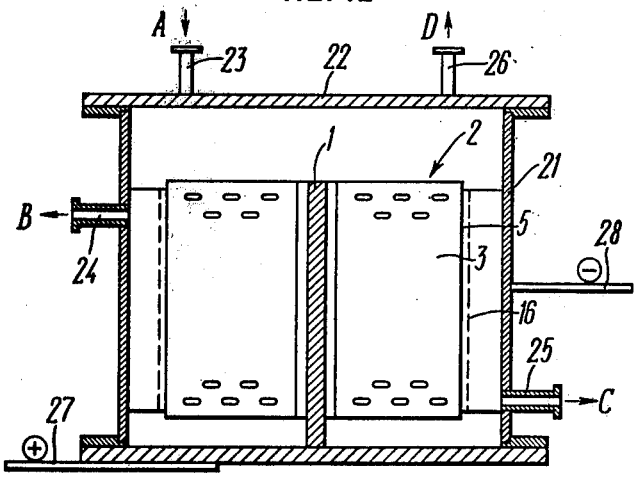
FIG. 19 is a section taken on the line XIX—XIX of FIG. 18.

FIG. 18 shows an electrode unit which comprises, in accordance with the invention, individual anode and cathode assemblies of FIGS. 1 and 2, respectively. Said anode and cathode assemblies are installed in an electrolyzer comprising a housing 21 with a cover 22, an inlet pipe 23 (FIG. 19) for the supply in the direction of the arrow A of solutions of halogenides of alkali metals into the housing 21, an outlet pipe 24 for the discharge in the direction of the arrow B of hydrogen released in the course of the electrolysis of solutions of halogenides of alakali metals at the electrode members 2 of the cathode assembly, an outlet pipe 25 for the removal in the direction of the arrow C of alkali produced in the course of the electrolysis at the electrode members 2 of the cathode assembly, an outlet pipe 26 for the removal in the direction of the arrow D of chlorine produced in the course of the electrolysis at the electrode members 2 of the anode assembly, a bus 27 for the supply of current to the anode assembly, and a bus 28 for the supply of current to the cathode assembly. In this case, the main current-distribution support of the electrode member 2 (FIG. 18) of the cathode assembly is the housing 21 (FIG. 19), whereto the cathode grid 16 is attached. The electrode members 2 of the anode assembly are arranged between the electrode members 2 of the cathode assembly, so that there is an interelectrode space between their working surfaces 3.

Figure 21:
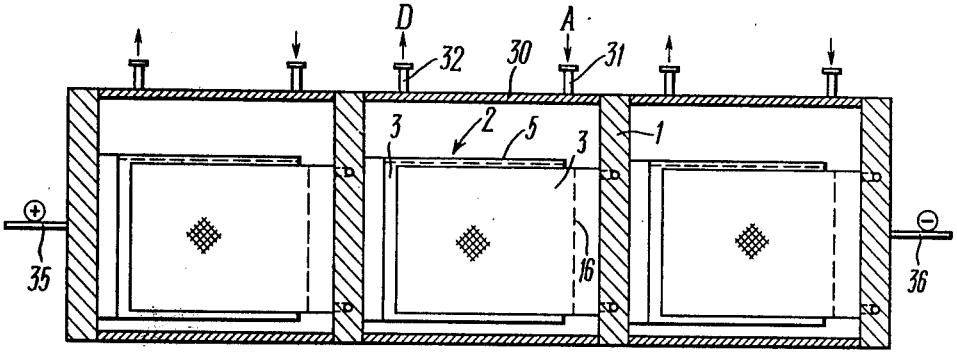
FIG. 21 is a section taken on the line XXI—XXI of FIG. 20.
Figure 20:
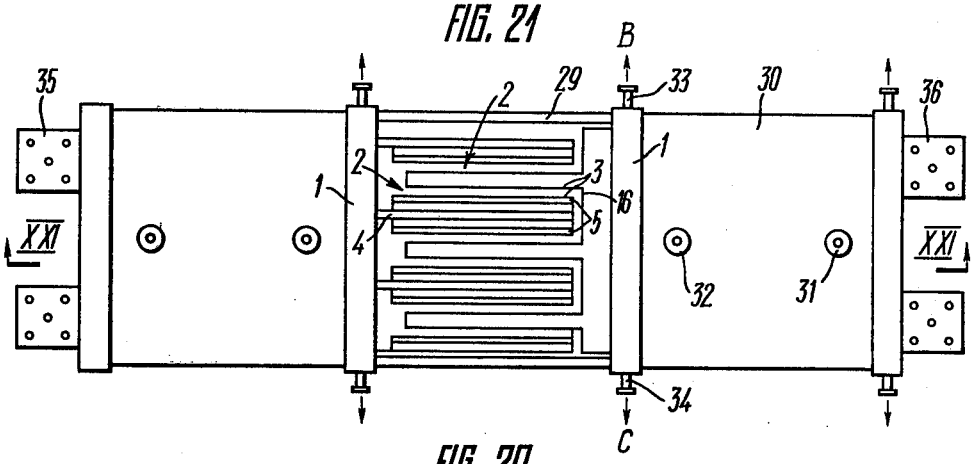
FIG. 20 is a plan view, with part of the cover broken away to show interior details, of an electrolyzer with bipolar electrodes in accordance with the invention, installed therein.

FIG. 20 shows an electrode unit which is a bipolar electrode of FIG. 3 installed in an electrolyzer comprising a housing 29, lids 30, and pipes 31 (FIG. 21), 32 and 33 (FIG. 20) and 34, respectively intended for the supply of solutions of halogenides of alkali metals into the housing 29 in the direction of the arrow A, the removal of chlorine in the direction of the arrow D, the removal of hydrogen in the direction of the arrow B, and the removal of alkali in the direction of the arrow C. The electrolyzer further comprises buses 35 and 36 intended for the supply of current to the electrode members 2 of the anode and cathode assemblies, respectively. The electrode members 2 of the anode assembly of the bipolar electrode are arranged between the electrode members 2 of the cathode assembly of the adjacent bipolar electrode, so that there is an interelectrode space between their working surfaces 3.

The operating principle of the electrode unit in accordance with the invention is the same for all the foregoing embodiments and will be described with reference to the embodiments of FIGS. 1, 2 and 3.

In the course of the electrolysis of solutions of halogenides of alkali metals, at the working surfaces 3 (FIGS. 1, 2, 18 and FIGS. 3 and 20), there are released chlorine and hydrogen. Chlorine is released at the working surface 3 of the electrode member of the anode assembly. Hydrogen is released at the working surface 3 of the electrode member of the cathode assembly. Alkali is also produced during the electrolysis. The gas that is released during the electrolysis is accumulated in the interelectrode space. But due to the fact that the working surfaces 3 of the electrode members 2 are arranged at an angle to the vertical plane, the degree of filling the interelectrode space with gas is independent of the height of the electrode members 2. The amount of gas in the interelectrode space is kept at a minimum, because gas bubbles rapidly pass through the mesh or perforations of the electrode members into the spacing between the support 4 and the plate 5.

As a result, the proposed design of an electrode unit makes it possible to raise the height of its electrode members by 50 to 70 percent and accordingly increase the output per unit of floor space. The minimum amount of gas in the electrolyte in the interelectrode space makes it possible to reduce the interelectrode spacing by 40 to 50 percent, so that the working voltage becomes substantially lower. The power consumption is reduced by 140 to 150 kilowatt-hours per 1 ton of chlorine. The proposed design provides for flexibility of the electrode members of the anode assembly, which facilitates the assembly of an electrolyzer and accounts for a uniform interelectrode spacing throughout the working surface of the electrode elements of the anode and cathode assemblies.

What is claimed is:

1. An electrode unit of an electrolyzer for the electrolysis of solutions of halogenides of alkali metals, which comprises:

a first vertically arranged current-distribution support comprising a planar segment;

at least one open-work or perforated electrode member having working surfaces, at which there is released gas in the course of the electrolysis of solutions of halogenides of alkali metals, said electrode member being disposed proximate to said planar segment and electrically connected thereto and being so arranged in relation to said support that said working surfaces are at a predetermined angle to a vertical plane normal to said planar segment of said first current-distribution support said predetermined angle being taken in a vertical plane substantially parallel to said planar segment.

2. An anode assembly of an electrolyzer for the electrolysis of solutions of halogenides of alkali metals, comprising:

a first vertically arranged current-distribution support having a first planar segment and a second planar segment;

a second current-distribution support having a first planar segment and a second planar segment said second current-distribution support being attached to one of said planar segments of said first current-distribution support and being electrically coupled thereto;

at least one open-work or perforated electrode member having working surfaces at which there is released gas in the course of the electrolysis of solutions of halogenides of alkali metals, said electrode member being electrically connected to said second current-distribution support and attached thereto so that said working surfaces are at a predetermined angle to a vertical plane normal to said one of said planar segments of said first current-distribution support and predetermined angle being taken in a vertical plane substantially parallel to one of said planar segments of said first support.

3. An anode assembly as claimed in claim 2, wherein said open-work or perforated electrode member comprises a first pair of plates having first and second plates joined to form a V-shaped member having one lower common end face and two upper end faces, said plates being attached to said second current-distribution support at the junction of said plates on the side of said common end face, so that said plates are respectively located at the sides of said first and second planar segment of said second current-distribution support.

4. An anode assembly as claimed in claim 3, wherein said open-work or perforated electrode member comprises at least one more pair of plates, a third plate of the additional pair being attached to said second current-distribution support on the side of said first planar segment thereof and on the side of said upper end face of said first plate of said V-shaped member, so that said working surfaces of said third plate are in the same planar segment with said working surfaces of said first plate, and a fourth plate of said additional second pair being attached to said second current-distribution support on the side of said second plane thereof and on the side of said upper end face of said second plate of said V-shaped member, so that said working surfaces of said fourth plate are in the same plane with said working surfaces of said second plate.

5. An anode assembly as claimed in claim 2, wherein said open-work or perforated electrode member has a first separate plate with a first end face and a second end face, arranged on the side of said first planar segment of said second current-distribution support, a second separate plate with a first end face and a second end face, arranged on the side of said second planar segment of said second current-distribution support; said second current-distribution support being shaped as an inverted T having a first cross-bar and a second cross-bar to which said separate plates are attached.

6. An anode assembly as claimed in claim 5, wherein said first end faces of said separate plates are in immediate proximity to said cross-bars of said second current-distribution support and are joined by a connecting strip into a single plate.

7. A cathode assembly of an electrolyzer for the electrolysis of solutions of halogenides of alkali metals, comprising:

a vertically arranged current-distribution support having a first planar segment and a second plane;

a cathode grid attached to one of said planar segments of said current-distribution support, at a predetermined gap from said planar segment;

at least one open-work or perforated electrode member having working surfaces at which there is released gas in the course of the electrolysis of said solutions, said electrode member being electrically connected to said cathode grid and attached thereto so that said working surfaces are at a predetermined angle to a vertical plane extending normal to said one of said planar segments of said current-distribution support to which said cathode grid is attached said predetermined angle being taken in a vertical plane substantially parallel to one of said planar segments.

8. A cathode assembly as claimed in claim 7, wherein said open-work or perforated electrode member is shaped as a triangular prism whose side edges are perpendicular to said one of said planar segments of said current-distribution support to which said cathode grid is attached.

9. A combination of electrode units of an electrolyzer for the electrolysis of solutions of halogenides of alkali metals, which combination includes:

an anode assembly comprising a first vertically arranged current-distribution support having a first planar segment and a second planar segment, a second current-distribution support having a first plane and a second planar segment and attached to one of said planes of of said first current-distribution support and electrically connected thereto, at least one first open-work or perforated electrode member having working surfaces at which there is released gas in the course of electrolysis of said solutions of halogenides of alkali metals, said electrode member being electrically connected to said second current-distribution support and attached thereto so that said working surfaces are at a predetermined angle to a vertical plane normal to said one of said planar segments of said first current-distribution support said predetermined angle being taken in a vertical plane substantially parallel to planar segments;

a cathode assembly comprising a third vertically arranged current-distribution support having a first planar segment and a second planar segment, a cathode grid attached to one of said planar segments of said third current-distribution support at a predetermined gap therefrom, at least one second open-work or perforated electrode member having working surfaces at which there is released gas in the course of the electrolysis of said solutions, said electrode member being electrically connected to said cathode grid and attached thereto so that said working surfaces are at a predetermined angle to a vertical plane extending normal to said one of said planar segments of said third current-distribution support to which said cathode grid is attached; said predetermined angles of said working surfaces of said first and second electrode members being taken in a vertical plane substantially parallel to said planar segments of said third support and being substantially equal so that said working surfaces are congruent with each other.

10. A combination as claimed in claim 9, wherein said second open-work or perforated electrode member is shaped as a triangular prism whose side edges are perpendicular to said one of said planar segments of the third current-distribution support to which said cathode grid is attached.

11. A combination as claimed in claim 10, wherein said first open-work or perforated electrode member comprises a first pair of plates having first and second plates joined to form a V-shaped member having one lower common end face and two upper end faces, said plates being joined to said second current-distribution support at the junction of these plates, on the side of said common end face, so that said plates are respectively arranged on the sides of said first and second planar segments of said second current-distribution support.

12. A combination as claimed in claim 11, wherein said first open-work or perforated electrode member includes at least one more pair of plates, a third plate of the additional pair being attached to said second current-distribution support on the side of said upper end face of said first plate of said V-shaped member, so that said working surfaces of said third plate are in the same plane with said working surfaces of said first plate, and a fourth plate of said additional second pair of plates being attached to said second current-distribution support on the side of said second planar segment thereof and on the side of said upper end face of said second plate of said V-shaped member, so that said working surfaces of said fourth plate are in the same plane with said working surfaces of said second plate.

13. A combination as claimed in claim 10, wherein said first open-work or perforated electrode member has a first separate plate with a first end face and a second end face, arranged on the side of said first planar segment of said second current-distribution support, a second separate plate with a first end face and a second end face, arranged on the side of said second plane of said second current-distribution support; said second current-distribution support being shaped as an inverted T having a first cross-bar and a second cross-bar to which said separate plates are attached.

14. A combination as claimed in claim 13, wherein said first end faces of said separate plates are in immediate proximity to said cross-bars of said second current-distribution support and are joined by a connecting strip into a single plate.

15. A bipolar electrode comprising:

an anode assembly including a first vertically arranged current-distribution support having a first planar segment and a second planar segment; a second current-distribution support having a first plane and a second planar segment, said second current-distribution support being attached to one of said planar segments of said first current-distribution support and being electrically connected thereto; at least one first open-work or perforated electrode member having working surfaces at which there is released gas in the course of the electrolysis of solutions of halogenides of alkali metals, said electrode member being electrically connected to said second current-distribution support and attached thereto so that said working surfaces are at a predetermined angle to a vertical plane normal to said one of said planar segments of said first current-distribution support said predetermined angle being taken in a vertical plane substantially parallel to said first support;

a cathode assembly including said first current-distribution support, which support is common for both assemblies; a cathode grid attached to one of said planar segments of said first current-distribution support at a predetermined gap therefrom; at least one second open-work or perforated electrode member having working surfaces at which there is released gas in the course of the electrolysis of said solutions, which electrode member is electrically connected to said cathode grid and attached thereto so that said working surfaces are at a predetermined angle to a vertical plane extending normal to said one of said planar segments of said first current-distribution support to which said cathode grid is attached; said predetermined angles of said working surfaces of said first and second electrode members being taken in a vertical plane substantially parallel to said planar segment of said first support and being substantially equal so that said working surfaces are congruent with each other.

16. A bipolar electrode as claimed in claim 15, wherein said second open-work or perforated electrode member is shaped as a triangular prism whose side edges are perpendicular to said one of said planar segments of said first current-distribution support to which said cathode grid is attached.

17. A bipolar electrode as claimed in claim 16, wherein said first open-work or perforated electrode member includes a first pair of plates having first and second plates joined to form a V-shaped member having one lower common end face and two upper end faces, said plates being attached to said second current-distribution support at the junction of said plates on the side of said common end face, so that said plates are respectively found on the sides of said first and second planar segments of said second current-distribution support.

18. A bipolar electrode as claimed in claim 17, wherein said first open-work or perforated electrode member includes at least one more pair of plates, a third plate of the additional pair of plates being attached to said second current-distribution support on the side of said first planar segment thereof and on the side of said upper end face of said first plate of said V-shaped member, so that said working surfaces of said third plate are in the same plane with said working surfaces of said first plate, and a fourth plate of said additional pair of plates being attached to said second current-distribution support on the side of said second plane thereof and on the side of said upper end face of said second plate of said V-shaped member, so that said working surfaces of said fourth plate are in the same plane with said working surfaces of said second plate.

19. A bipolar electrode as claimed in claim 15, wherein said first open-work or perforated electrode member has a first separate plate with a first end face and a second end face, arranged on the side of said first planar segment of said second current-distribution support; a second separate plate with a first end face and a second end face, arranged on the side of said second planar segment of the second current-distribution support; said second current-distribution support being shaped as an inverted T having a first cross-bar and a second cross-bar to which said separate plates are attached.

20. A bipolar electrode as claimed in claim 19, wherein said first end faces of said separate plates are in immediate proximity to said cross-bars of said second current-distribution support and are joined by a connecting strip into a single plate.

* * * * *